US006325298B1

(12) United States Patent
Hielm

(10) Patent No.: US 6,325,298 B1
(45) Date of Patent: Dec. 4, 2001

(54) INDUCTION HEAT GENERATOR FOR THE REDUCTION OF EMISSIONS FROM AN INTERNAL COMBUSTION ENGINE

(75) Inventor: Odd Hielm, Eldsberga (SE)

(73) Assignee: AB Konstruktions-Bakelit, Oerkelljunga (SE)

( * ) Notice: Subject to any disclaimer, the term of this patent is extended or adjusted under 35 U.S.C. 154(b) by 1 days.

(21) Appl. No.: 09/654,455

(22) Filed: Aug. 31, 2000

Related U.S. Application Data

(63) Continuation of application No. PCT/SE99/00283, filed on Mar. 1, 1999.

(30) Foreign Application Priority Data

Mar. 2, 1998 (SE) ..... 9800630

(51) Int. Cl.[7] ..... F24C 9/00; H05B 6/10

(52) U.S. Cl. ..... 237/12.3 R; 219/631; 219/628; 219/635

(58) Field of Search ..... 219/630, 631, 219/628, 629, 672, 670, 635; 122/26; 126/247; 237/12.3 R

(56) References Cited

U.S. PATENT DOCUMENTS

| | | | | |
|---|---|---|---|---|
| 2,549,362 | * | 4/1951 | Bessiere et al. | 219/631 |
| 4,484,049 | | 11/1984 | Ahner et al. | 219/631 |
| 4,511,777 | * | 4/1985 | Gerard | 219/631 |
| 4,600,821 | | 7/1986 | Fichtner et al. | 219/631 |
| 5,012,060 | | 4/1991 | Gerard et al. | 219/631 |
| 5,573,184 | | 11/1996 | Martin | 237/12.3 R |
| 5,914,065 | * | 6/1999 | Alavi | 219/631 |
| 6,144,020 | * | 11/2000 | Usui et al. | 219/631 |

FOREIGN PATENT DOCUMENTS

A1087727 9/1983 (EP) .

* cited by examiner

*Primary Examiner*—Philip H. Leung

(57) ABSTRACT

In order to reduce emissions from a liquid-cooled internal combustion engine, the cooling liquid of the internal combustion engine is heated by a heat generator that is driven by the internal combustion engine as long as the working temperature of the internal combustion engine is below a predetermined value. The heat generator includes a driven rotor and a stator, in which the rotor when rotated induces electric currents that generate heat. The rotor includes a soft magnetic material and supports a plurality of permanent magnets, which generate a magnetizing field of the rotor. The stator has a ring of non-magnetic, electrically conductive material. The ring is arranged along the periphery of the rotor such that the magnetizing field of the rotor passes through the ring. A chamber which likewise extends along the periphery of the rotor and of which the stator is at least part, permits the circulation of a liquid for absorbing the heat generated in the stator ring, when the rotor is driven to rotate.

14 Claims, 2 Drawing Sheets

INDUCTION HEAT GENERATOR FOR THE REDUCTION OF EMISSIONS FROM AN INTERNAL COMBUSTION ENGINE

This appln. is a con't of PCT/SE99/00283 filed Mar. 1, 1999.

BACKGROUND OF THE INVENTION

1. Field of the Invention

The present invention generally relates to internal combustion engines and more specifically to a heat generator for the reduction of emissions from an internal combustion engine.

As a consequence of successively improved efficiency, modern internal combustion engines generate relatively less heat than older types of internal combustion engines. This implies an undesired extension of the time required for the engine, when started, to reach a suitable working temperature, at which the emissions of the engine normally are reduced to a minimum. Consequently, the prolonged heating-up period of the engine leads to an undesired increase of the emissions of the internal combustion engine. The colder the climate in which the vehicle driven by the internal combustion engine is used, of course the longer the prolongation of the heating-up period and the greater the total increase of the emissions.

2. Description of the Background Art

A water-cooled heat generator for the coupe of a vehicle is known from U.S. Pat. No. 4,484,049. This heat generator comprises a shaft which is driven by the vehicle engine and which is the same for the rotor in an alternator and a rotor in the actual heat generator. Alternating current drawn from the stator winding of the alternator is rectified and transferred as magnetising current to the rotor in the heat generator. Moreover, the heat generator has a laminated stator with armature rods which are connected between two short circuiting rings and which, as is the case with the short circuiting rings, are hollow. The armature rods, in which the rotor of the heat generator generates induction currents when rotating, as well as the short circuiting rings, are cooled by means of water that is circulated through the same. The water thus heated is in turn used for heating the vehicle coupé.

This heat generator is bulky, complicated and in addition it has low efficiency and consequently it is of little value as a heat generator for the reduction of emissions from an internal combustion engine.

Another heat generator for motor vehicles is disclosed in U.S. Pat. No. 5,573,184, in which a viscous liquid is heated by means of a rotor driven by the vehicle engine and in its turn heats the cooling liquid of the engine. Also this heat generator based on frictional heat has unsatisfactory efficiency and is necessarily relatively bulky.

SUMMARY OF THE INVENTION

Consequently, an object of the present invention is to provide a heat generator, which permits a more efficient reduction of the emissions from an internal combustion engine by reducing its heating-up period to a desired working temperature.

According to the invention, this object is achieved by means of a heat generator for a liquid-cooled internal combustion engine. The liquid-cooled internal combustion engine includes at least a rotor, a stator and a chamber.

According to the invention, a heat generator is thus provided, which comprises a rotor driven by the internal combustion engine and a stator, in which the rotor when rotating induces electric currents which generate heat for heating the cooling liquid of the engine. More specifically, the heat generator is characterised in that the rotor consists of a soft magnetic material and supports a plurality of permanent magnets, which generate the magnetising field of the rotor, that the stator comprises a ring of electrically conductive, preferably non-magnetic material, which ring is arranged along the periphery of the rotor such that the magnetising field of the rotor passes through the same, and that a chamber, which likewise extends along the periphery of the rotor and of which the stator is at least part, permits the circulation of the cooling liquid of the internal combustion engine for absorbing the heat which is generated in the stator ring, when the rotor is rotated.

In a preferred embodiment, the rotor comprises a shaft and two discs of soft magnetic material which are fixedly mounted on the same and axially spaced. Each one of the permanent magnets is fixedly connected to one of the opposing surfaces of the discs, so that the permanent magnets are uniformly distributed both between the surfaces and on each one of them. Finally, the stator ring is arranged between the two rotor discs and their permanent magnets.

Furthermore, the permanent magnets on each rotor disc are suitably arranged to generate axial magnetic fields (seen immediately adjacent to the permanent magnets) in opposite directions when moving from one permanent magnet to the next in the circumferential direction around the rotor.

The stator ring can consist of two annular, axially spaced discs of electrically conductive and preferably non-magnetic material, which are fixedly interconnected and which between themselves form the chamber for the circulation of the cooling liquid of the internal combustion engine.

A housing encloses the rotor, and the stator ring is fixedly mounted in this housing, for instance, by the two discs of the stator ring being clamped between two axially spaced parts of the housing. Thus the emissions from a liquid-cooled internal combustion engine can be reduced by heating the cooling liquid of the internal combustion engine with the aid of a heat generator driven by the internal combustion engine as long as the working temperature of the internal combustion engine is below a predetermined value.

The cooling liquid is then passed through the heat generator and preferably the driving of the internal combustion engine is activated or deactivated depending on whether the working temperature of the engine is below the predetermined value or not.

BRIEF DESCRIPTION OF THE DRAWINGS

Below, an embodiment of a heat generator according to the invention will be described in more detail with reference to the accompanying drawings, in which.

DETAILED DESCRIPTION OF THE PREFERRED EMBODIMENTS

Figure 1:
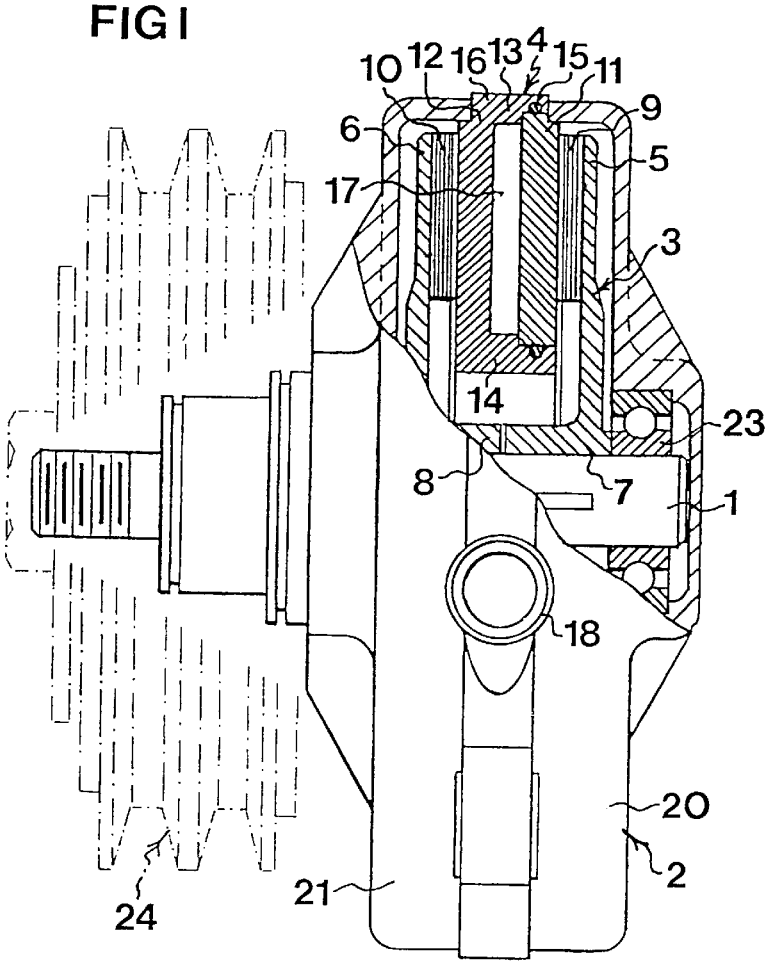
FIG. 1 is a side view of an embodiment of a heat generator according to the invention, with parts broken away.
Figure 2:
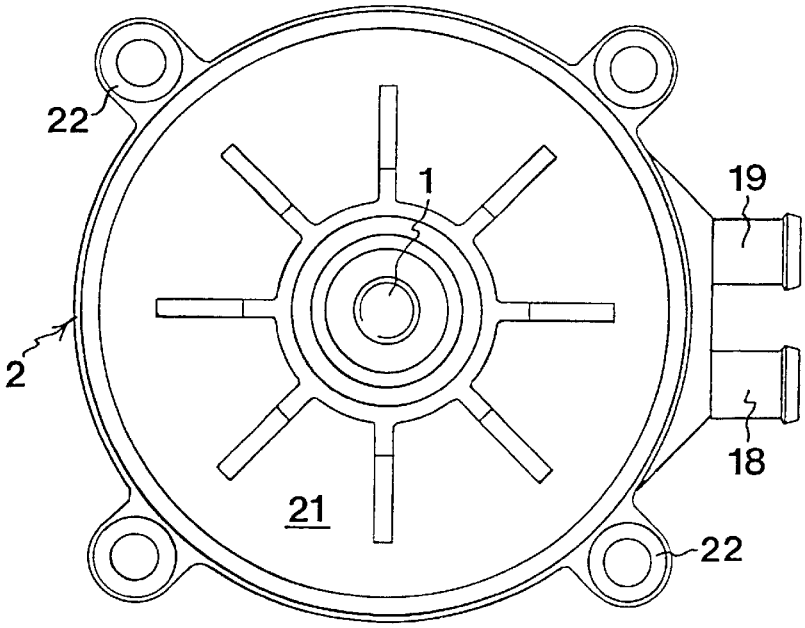
FIG. 2 is a front view of the heat generator in FIG. 1.

The heat generator illustrated in FIGS. 1 and 2 has a shaft 1, which is rotatably mounted in a housing 2. A rotor 3 is fixedly mounted on the shaft 1 and a stator 4 is fixedly mounted in the housing 2.

The shaft 1 is intended to be driven by an internal combustion engine in a car, such that the shaft 1 and the rotor 3 rotate together in relation to the fixed housing 2 and the stator 4 which is fixedly mounted in the housing.

The rotor 3 is constructed with two radially extending discs 5 and 6, which are each integral with a hub 7, 8, which can be pushed on to the shaft 1 and locked against rotation in relation to the same. On each disc 5, 6, a plurality of permanent magnets 9 and 10, respectively, are mounted and more particularly axially on the opposing sides of the respective discs 5, 6.

The permanent magnets 9, 10 can consist of physically separate units on each disc 5, 6 or consist of a single ring magnet on each disc 5, 6. Each ring magnet is then suitably magnetised as a plurality of magnets circumferentially arranged and having axial magnetic fields in opposite directions when moving from one permanent magnet to the next in the circumferential direction around the respective discs 5, 6 of the rotor 1.

According to FIGS. 1 and 2, the stator 4 consists of two rings 11 and 12, which are made of an electrically conductive and preferably non-magnetic material, for instance, aluminium. The ring 11 is planar, whereas the ring 12 has an outer flange 13 and an inner flange 14, each having an abutment for connecting to the ring 12 at a predetermined distance while being sealed with the aid of an O-ring 15.

The rings 11, 12 together form a central, radially projecting collar 16 as well as a central chamber 17 within the stator 4. As seen in FIGS. 1 and 2, this chamber 17 has an inlet 18 and an outlet 19 and a partition wall (not shown) between the inlet 18 and the outlet 19, so that a substantially circular duct having a rectangular cross-section is obtained between the inlet 18 and the outlet 19.

The housing 2 consists of two cup-shaped shields 20 and 21, which each have attachment lugs 22 for fixing the shields in relation to each other, the stator 4 being located between the shields. In addition, there is a bearing 23 for the shaft 1 in each shield 20, 21.

The magnetic field established by each permanent magnet 9 in FIGS. 1 and 2 and the magnetic flux thus generated are closed via the rotor disc 5, the stator disc 11 and each of the two adjacent permanent magnets 9.

This also applies to the permanent magnets 10 in FIGS. 1 and 2.

Consequently, when the rotor 3 is rotated the magnetic fields in the stator 4 are changed, which induces currents in the same in the form of short-circuit currents, which strive to counteract the changes in the magnetic field. As a result of these currents, heat is generated in the stator 4, which heat is transferred to the liquid, preferably water, which circulates through the duct 17.

By virtue of the inventive design with a permanentmagnetised rotor and a directly connected stator of electrically conductive, preferably non-magnetic material, mechanical energy transferred to the rotor 3 is very efficiently converted to heat energy in the liquid circulated through the duct 17.

Alternatively, a heat generator according to the invention could comprise a rotor in the form or a cylindrical ring, which is mounted in bearings to be rotated on a shaft and which consists of soft magnetic material. The permanent magnets are then attached to the outside of the ring. Furthermore, these permanent magnets are magnetised to generate radial magnetic fields with alternating polarities from one magnet to the next when moving in the circumferential direction.

In this alternative embodiment, a likewise cylindrical stator of electrically conductive, preferably nonmagnetic material is arranged to enclose the rotor and the permanent magnets thereon. Further, the heat generator has a housing, which together with the stator forms a chamber, which encloses a major part of the stator. The chamber has an inlet and an outlet to permit the circulation of a liquid.

By using modern ceramic permanent magnets having high remanence, i.e. at least approximately 1 T, and high coercive field strength, i.e. magnetically hard materials, a heat generator according to FIGS. 1 and 2 having a diameter of about 14 cm and an axial length of about 5 cm at a speed in the range of 2500 rpm can generate a heat effect of about 12 kW, which means that water which is circulated through the heat generator can be heated from 20° C. to 95° C. at a rate of more than 2 l/min.

Furthermore, according to the invention the permanent magnets can consist of a material having a remanence value, which is temperature-dependent such that it decreases considerably at temperatures above a certain predetermined temperature, e.g. approximately 95° C., and regains its high remanence value as soon as the temperature falls below this temperature. The variation in remanence must thus be reversible. With such a material, the output of the heat generator will be almost self-adjusting to the output required for reaching and maintaining the desired working temperature in the internal combustion engine. In other words, the remanence variation could be used instead of or as a complement to the magnetic coupling.

As an additional modification, the stator can consist of a so-called PTC material, i.e. a material whose resistance has a positive temperature coefficient with such a variation that the resistance increases sharply within a certain temperature range, e.g. beginning from approximately 95° C. The result of such a change of the resistance in the stator of the heat generator is a considerable decrease of the short-circuit currents in the stator and thus a considerable decrease of the output of the heat generator. This variation in resistance could, of course, be used in the same way as the variation in remanence mentioned above.

Figure 3:
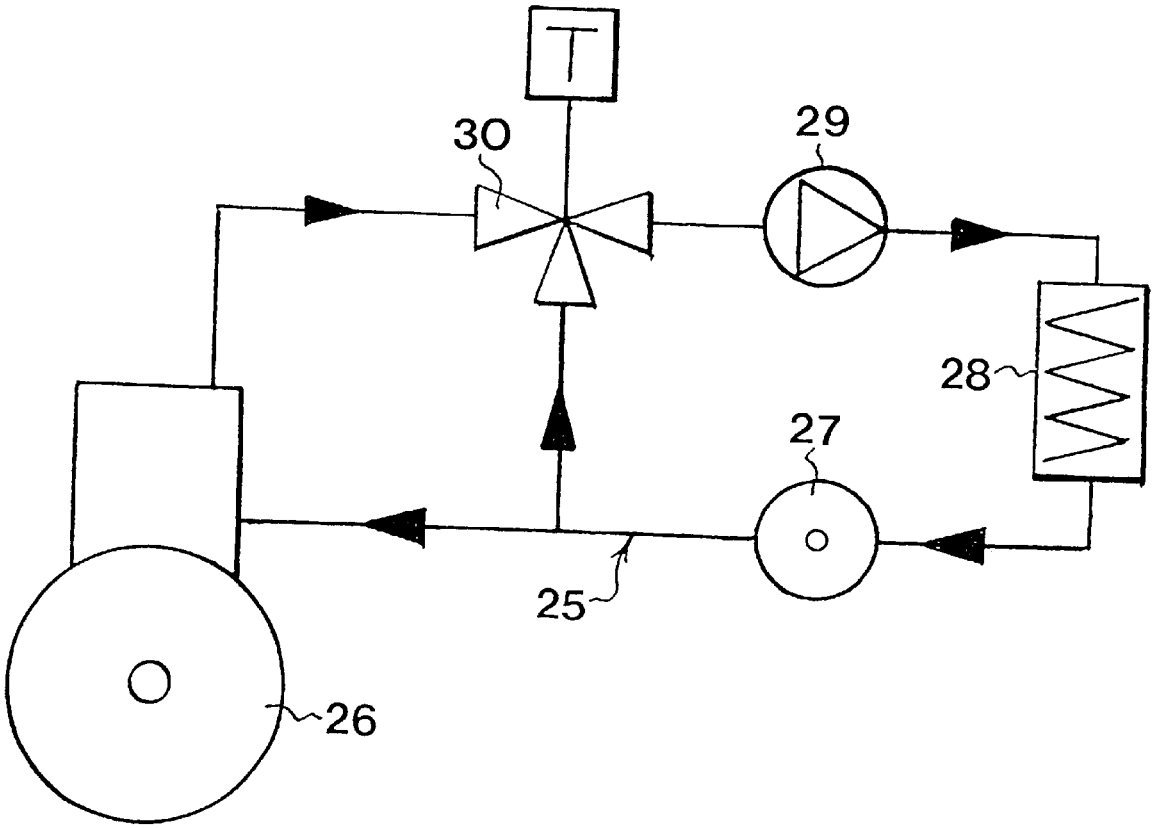
FIG. 3 is a schematic view of a heating system in a vehicle, which system utilises a heat generator according to the invention.

As indicated by dash-dot lines in FIG. 1, a heat generator according to the invention can be connected and disconnected by means of a thermostatically controlled magnetic coupling 24 in such a circulation loop 25 for water through the internal combustion engine 26 shown in FIG. 3. Besides a heat generator 27 according to the invention, FIG. 3 illustrates a heat exchanger 28 for heating the coupe air, a circulation pump 29 and a thermallyoperated valve 30.

Hence a faster increase of the engine temperature is achieved when starting the engine, which results in advantages in terms both of a smaller total amount of undesired exhaust fumes or emissions and of a lower total fuel consumption. Once the desired working temperature has been reached in the internal combustion engine 26, the output of the heat generator 27 is stopped by disconnecting the heat generator 27 from the internal combustion engine, preferably by means of the thermostatically controlled magnetic coupling 24, or at least considerably reduced by the change in remanence in the permanent magnets 9, 10 and/or the change in resistance in the stator 4.

Several modifications of the embodiments described above are possible within the scope of the invention, as defined in the appended claims. It is thus feasible to use the heat generator for both heating the internal combustion engine and heating the vehicle coupé. In this application, the thermally-operated valve 30 can be used.

What is claimed is:

1. An apparatus for the reduction of emissions from a liquid-cooled internal combustion engine having a cooling liquid circulation loop, comprising:

a heat generator driven by the internal combustion engine and connected into said cooling liquid circulation loop to heat a liquid provided within the circulation loop so as to speed up an increase of a temperature of the internal combustion engine and thereby reduce the emissions therefrom;

said heat generator including a rotor having a shaft driven by the internal combustion engine, a disc of a soft magnetic material, and a plurality of permanent magnets said permanent magnets generating a magnetizing field of the rotor, fixedly connected to the disc and axially extending from said disc, a stator having a ring of electrically conductive material, wherein the ring is arranged along a periphery of the rotor such that the magnetizing field of the rotor passes through the stator and induces electric currents which generate heat in the stator ring, and a chamber extending along the periphery of the rotor, said chamber including an inlet and an outlet connecting the chamber into the circulation loop of the internal combustion engine, the stator being part of the chamber, and which permits circulation of the cooling liquid of the internal combustion engine between the inlet and the outlet for absorbing the heat which is generated in the stator ring, when the rotor is rotated.

2. The apparatus according to claim 1, wherein the disc is fixedly mounted on the shaft and the stator ring is arranged beside the permanent magnets on a side which is axially opposite to the rotor disc.

3. The apparatus according to claim 2, wherein the permanent magnets are arranged to generate axial magnetic fields having opposite directions when moving from a one permanent magnet to an adjacent permanent magnet with respect to a circumferential direction around the rotor.

4. The apparatus according to claim 1, wherein the rotor comprises two discs mounted on the shaft in a fixed and axially spaced manner and which are made of soft magnetic material, the permanent magnets are fixedly connected to at least one opposing surface of the discs, and the stator ring is arranged between the two rotor discs and the permanent magnets.

5. The apparatus according to claim 4, wherein the permanent magnets on each rotor disc are arranged to generate axial magnetic fields in opposite directions when moving from a one permanent magnet to an adjacent permanent magnet with respect to a circumferential direction around the rotor.

6. The apparatus according to claim 4, wherein the stator ring comprises two annular, axially spaced discs, and wherein said discs are interconnected and independently form the chamber.

7. The apparatus according to claim 6, wherein the shaft of the rotor is mounted in bearings in a housing, said housing enclosing the rotor and having the stator ring fixedly mounted therein.

8. The apparatus according to claim 6, wherein the two discs of the stator ring are clamped between two axially spaced parts of the housing.

9. The apparatus according to claim 1, wherein the permanent magnets consist of a material, whose remanence is temperature-dependent and decreases above a predetermined temperature.

10. The apparatus according to claim 1, wherein the stator consists of a PTC material.

11. An apparatus for the reduction of emissions from a liquid-cooled internal combustion engine having a cooling liquid circulation loop, comprising:

a heat generator, which is driven by the internal combustion engine and is connected into said cooling liquid circulation loop to heat a cooling liquid within the circulation loop so as to speed up an increase of a temperature of the internal combustion engine and thereby reduce the emissions therefrom, said heat generator including:

a rotor having a shaft driven by the internal combustion engine, a disc of a soft magnetic material fixed on the shaft and a plurality of permanent magnets, the plurality of magnets generating a magnetizing field of the rotor and are fixedly connected to the disc axially extending therefrom, said magnets consisting of a material having a remanence temperature-dependent and decreasing above a predetermined temperature, a stator comprising a ring of electrically conductive material, said ring arranged along a periphery of the rotor beside the permanent magnets on a side which is axially opposite to the rotor disc, such that the magnetizing field of the rotor passes through the stator and induces electric currents which generate heat in the stator ring, and a chamber extending along the periphery of the rotor and having an inlet and an outlet connecting the chamber into the circulation loop of the internal combustion engine, the stator being part of the chamber, and which permits circulation of the cooling liquid of the internal combustion engine for absorbing the heat which is generated in the stator ring, when the rotor is rotated.

12. A liquid-cooled internal combustion engine having reduced emissions, comprising:

a circulation loop;

a circulation pump in said circulation loop; and a heat generator connected into said circulation loop so as to speed up the increase of a temperature of the internal combustion engine and thereby reduce the emissions therefrom, wherein said heat generator comprises a rotor having a shaft driven by the internal combustion engine, a disc of a soft magnetic material fixed on the shaft, and a plurality of permanent magnets, wherein the permanent magnets generate a magnetizing field of the rotor and are fixedly connected to the disc extending axially from the disc, a stator comprising a ring of electrically conductive material, said ring arranged along a periphery of the rotor such that the magnetizing field of the rotor passes through the stator and induces electric currents which generate heat in the stator ring, and a chamber extending along the periphery of the rotor, said chamber having an inlet and an outlet connecting the chamber into the circulation loop of the internal combustion engine, the stator being part of the chamber, and which permits circulation of the cooling liquid of the internal combustion engine for absorbing the heat which is generated in the stator ring, when the rotor is rotated.

13. A method of reducing emissions from an internal combustion engine having a circulation loop and a circulation pump therein for a cooling liquid, said method comprising the steps of:

providing a heat generator which comprises:

a rotor having a shaft, a disc of a soft magnetic material fixed on the shaft, and a plurality of permanent magnets, the plurality of permanent magnets generating a magnetizing field of the rotor and fixedly connected to the disc extending axially from therefrom, a stator having a ring of electrically conductive material, wherein the ring is arranged along a periphery of the rotor such that the magnetizing field of the rotor passes through the stator, and a chamber extending along the periphery of the rotor and having an inlet and an outlet connecting the chamber into the circulation loop of the internal combustion engine, the stator being part of the chamber;

driving the shaft of the heat generator by the internal combustion engine; and circulating the cooling liquid of the internal combustion engine for absorbing heat which is generated in the stator ring when the rotor is rotated by the internal combustion engine via the shaft and inducing electric currents in the stator ring, the absorbing of heat thereby accelerating an increase of a temperature of the internal combustion engine and thereby reducing emissions therefrom.

14. The method according to claim 13, further comprising the additional step of:

controlling an induction of electric currents in the stator ring when a temperature of the internal combustion engine is above a predetermined temperature.

* * * * *